US007454801B1

(12) United States Patent
Rie

(10) Patent No.: US 7,454,801 B1
(45) Date of Patent: Nov. 25, 2008

(54) COMMODES WITH USER'S UPPER-BODY SUPPORT

(76) Inventor: Jin Rie, 401 N. Bixel St., Los Angeles, CA (US) 90026

( * ) Notice: Subject to any disclaimer, the term of this patent is extended or adjusted under 35 U.S.C. 154(b) by 0 days.

(21) Appl. No.: 12/082,998

(22) Filed: Apr. 17, 2008

Related U.S. Application Data

(60) Provisional application No. 60/962,484, filed on Jul. 30, 2007.

(51) Int. Cl.
*E03D 11/00* (2006.01)

(52) U.S. Cl. ..... 4/254; 4/420; 4/353

(58) Field of Classification Search ..... 4/144.3, 4/234, 254, 301, 405, 411, 661, 300, 353, 4/420

See application file for complete search history.

(56) References Cited

U.S. PATENT DOCUMENTS 2,185,887 A * 1/1940 Dennis ..... 4/311
2,741,287 A * 4/1956 Michuad ..... 4/661
3,964,111 A * 6/1976 Packer ..... 4/144.4
4,012,797 A * 3/1977 Kristoffersen ..... 4/254
4,023,216 A * 5/1977 Li ..... 4/144.3
4,681,573 A * 7/1987 McGovern et al. ..... 4/144.3
4,777,671 A * 10/1988 Kearns ..... 4/667
4,815,151 A * 3/1989 Ball ..... 4/144.3
4,937,890 A * 7/1990 Tafur ..... 4/144.4
5,329,645 A * 7/1994 Fossum et al. ..... 4/254
5,996,133 A * 12/1999 Fletcher ..... 4/237
6,324,705 B1 * 12/2001 Zephier ..... 4/254
6,370,705 B1 * 4/2002 Levinson ..... 4/301
6,571,399 B1 * 6/2003 Wagener ..... 4/301
6,814,719 B2 * 11/2004 Preston et al. ..... 604/329
7,194,772 B2 * 3/2007 Rie ..... 4/254

* cited by examiner

*Primary Examiner*—Tuan N Nguyen

(57) ABSTRACT

A commode chair with user's upper-body support is provided. The seat assembly of the commode, including bowl, seat, and lid, is formed to support a user to sit on a commode facing the upper-body support. The seating assembly has a narrow width to the direction of the upper-body support and has wider width on the opposite side. An overview of the seating assembly has a shape of an oval facing the upper-body support with the sharp end, a bicycle saddle. The upper-body support is leaned opposite direction of the commode to allow a user to rest his/her upper body thereon. This sitting position reduces pressure build up of the lower body of the user around the commode seat and provides a convenient and more comfortable resting time.

3 Claims, 9 Drawing Sheets

COMMODES WITH USER'S UPPER-BODY SUPPORT

Current application is a non-provisional application of a provisional application 60/962,484, which is received on Jul. 30, 2007.

FIELD OF THE INVENTION

Current application relates to a combination of a commode chair and an upper-body support, more particularly, to a new commode chair with enhanced user support for reducing pressure concentration points on the lower body of a user while providing enhanced support of the upper body of the user.

BACKGROUND OF THE INVENTION

When a user sits on a conventional commode, the water tank is always placed behind the user and all of the user's weight is supported by a narrow area that is the seating assembly of the commode. Therefore, the pressure build up in the user's lower body is more than negligible. Extended sitting—over 15 minutes—on a conventional commode creates pain to the user's lower body along the contact area with the seat. For an overweight user or a user who suffers from constipation and hemorrhoids, these conventional commodes provide great pain. Some commodes are modified to support patients who have difficulty in moving. However, those modified commodes do not eliminate the inconvenience for the users who suffer from such aforementioned ailments. It is the purpose of the current application to provide a commode that provides a convenient and compatible resting time not only to the users who are suffering from the ailments mentioned above but also to all other users.

DESCRIPTION OF THE PRIOR ART

U.S. Pat. No. 7,194,722 to Rie illustrates a commode chair with reversed seat facing a water tank is provided. The seating assembly has a narrow width to the direction of a water tank and has wider width on the opposite side. The water tank is leaned backwards in relation to the commode to allow a user to rest his/her upper body thereon.

U.S. Pat. No. 6,370,705 to Levinson illustrates a female urinal comprising a body having a connection portion for attachment to a support, a receiving portion at the remote end from the support into which a female urinates, and a straddling portion interposed therebetween. The straddling portion is configured to afford space for the location of a user's thighs such that she can comfortably position herself above the urinal for accurate urination.

U.S. Pat. No. 6,324,705 to Zephier illustrates a commode chair with enhanced user support for reducing pressure concentration points on the body of the user while providing enhanced support of the body of the user. The commode chair includes a commode chair for enhancing sitting comfort on a commode, and which includes a seat assembly, a support assembly, and a bladder. The seat assembly supports the buttocks of a user, and comprises a platform having an upper surface and a lower surface. The support assembly is mounted on the platform assembly for engaging an upper rim portion of the bowl portion of a commode.

U.S. Pat. No. 5,996,133 to Fletcher illustrates a toilet aid, for use on an ordinary water closet/toilet fitted with an ordinary lift up toilet seat, which aid comprises an overseat supported on an annular or part annular pneumatically inflatable bag assembly, and is characterized in that flexible locating means is attached to a bottom part of the bag assembly so as to be foldable or bendable to extend beneath the toilet seat to locate the bag assembly on the toilet seat for pneumatically raising and lowering the overseat relative thereto.

U.S. Pat. No. 5,329,645 to Fossum, et al. illustrates a device for providing support for a user seated on a commode and comprising a substantially U-shaped framework attached to a wall behind the commode includes a pair of elongated horizontal members joined by a crossbar and having legs at its forward corners. The framework is rotated through substantially 90. degree, to rest with its legs on the floor in front of the commode. A padded tray is slidably mounted on and rotatable with the horizontal members of the frame-work and is moved closely adjacent to the user when the user is seated on the commode. When not in use, the device is rotated upward, folded against the wall, and secured to the wall by a clip. The device is preferably made of polyvinyl chloride pipe and the tray is covered with a sheet of plastic material.

U.S. Pat. No. 4,777,671 to Kearns illustrates toilet seat assembly is provided having a seat that is pivotably supported at its forward end for swinging movement between substantially horizontal and upwardly inclined positions. A power lift mechanism is incorporated in the assembly and is selectively operable by the user to pivot the seat and support the seat in a desired position for assisting the user in moving between seated and standing positions. The power lift mechanism includes an expandable bladder of the bellows disposed at the rear of the seat assembly between a base structure adapted to be secured on the top of a toilet bowl and the pivoted seat that is also mounted on the base structure. A fluid control system is coupled with the expandable bladder and adapted to be connected with a source of pressurized fluid and has a manually actuated control valve operable by the user to permit admission of pressurized fluid into the bladder to cause its expansion and upward pivoting of the seat or to permit outflow of fluid from the bladder resulting in construction of the bladder and pivoting of the seat towards a horizontal position.

U.S. Pat. No. 4,012,797 to Kristoffersen illustrates a single water closet or toilet fixture for dual functional use as either a western style fixture wherein the user is in the sitting position and normally facing forward, or an eastern style fixture wherein the user is in the squatting position and facing either in the forward direction or the aft direction depending on the embodiment utilized. An external footrest is provided on each side of the fixture for supporting the user in the squatting position. A movable toilet seat when folded down onto the lower bowl portion of the toilet fixture is proportioned for use in the sitting position; and when the toilet seat is raised to an upright position, a fore and aft elongated receptacle or bowl portion is exposed which is relatively narrow in width for straddling and is proportioned for use in the squatting position. Also, formed integral with the bowl portion of the fixture, is a urine spray shield which nestles under the contoured toilet seat and is functional in both the sitting and the squatting positions. The necessary height difference between the two function positions of sitting and squatting is incorporated into the height or thickness of the movable seat, in order that fixture can be made low enough to squat on without bodily supporting contact with the user and high enough to sit on.

None of the prior art illustrates a commode that can reduce the pressure build up in the lower body of the user drastically by resting the whole upper body of the user on an upper-body support.

SUMMARY OF THE INVENTION

The general purpose of the current application is to provide a new commode chair with enhanced user's upper-body support generated by a separate support. Many of the advantages of the commode chair of the current application and many novel features that result in a new commode chair with enhanced user's upper-body support is not anticipated, rendered obvious, suggested, or even implied by any of the prior art commode chairs, either alone or in any combination thereof.

To attain this, the present invention generally comprises a commode chair for enhancing sitting comfort on a commode, including a seat assembly and an upper-body support. The upper-body support may be a water tank, a reservoir for vagina cleansing solution or just a statue of the user's favorite person. The seat assembly supports the buttocks of a user, and comprises a platform having an upper surface and a lower surface. A commode chair with a seat facing an upper-body support is provided. The upper-body support supports the user for reducing pressure build up on the body. The seat assembly including bowl, seat, and lid are formed to support a user to sit on a commode facing the upper-body support. The seating assembly has a narrower width on the side closest to the upper-body support and has a wider width on the opposite side. An over view of the seating assembly has a shape of an oval facing the upper-body support with the sharp end. The upper body support is leaned backwards on the commode to allow a user to lean his/her upper body against thereon. This sitting position reduces the pressure build up at the lower body of a user around the commode seat and provides a convenient resting time.

DETAILED DESCRIPTION OF THE PREFERRED EMBODIMENT

Figure 1:
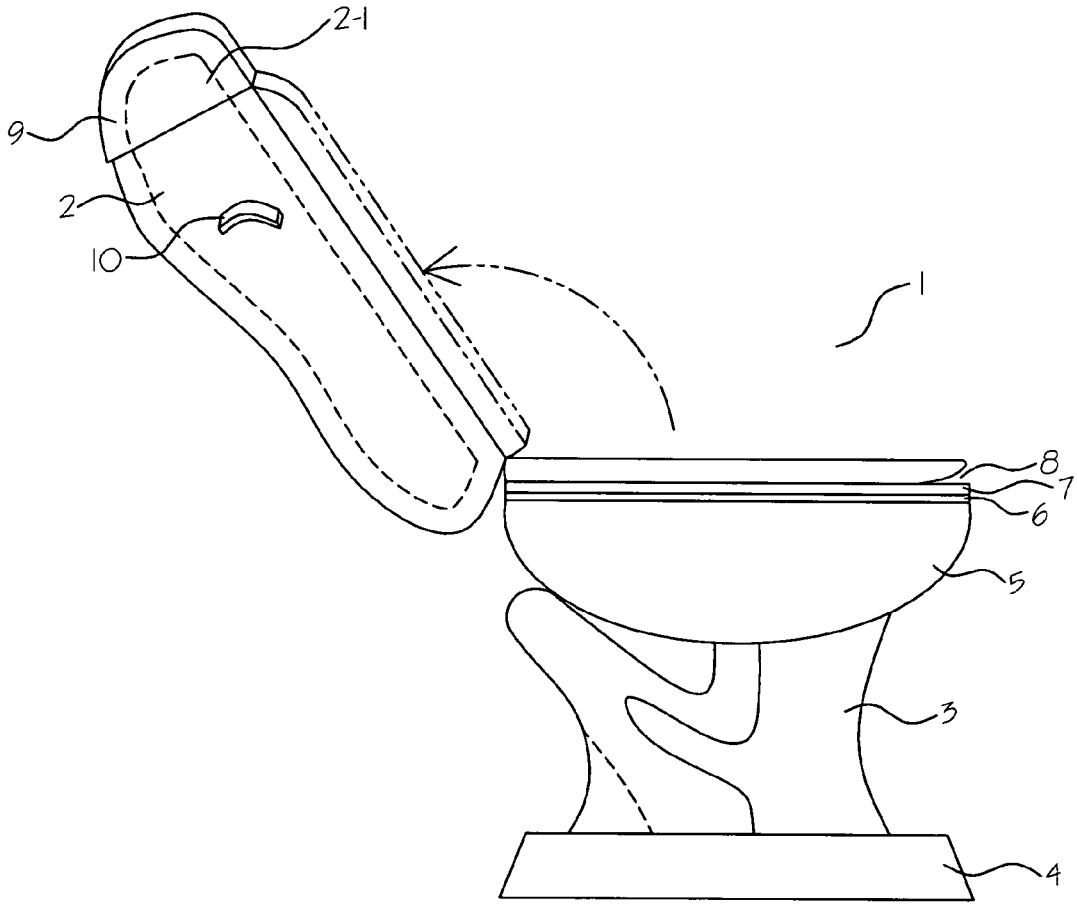
FIG. 1 is a side view of a commode with an upper-body support of the current application.

FIG. 1 is a side view of a commode (1), with an upper-body support, of the current application. The commode (1) is comprised of an upper-body support (2), a base (3), a base plate (4), a bowl (5), a bowl lip (6), a seat (7) and a seat lid (8). As shown in the FIG. 1, the upper-body support (2) is leaned to or tilted the opposite direction of the bowl (5). The upper-body support (2) being tilted in an orientation away from vertical such that an axis thereof will meet a longitudinal axis of the bowl in an obtuse angle in order for the upper body-support to lend support to a user's upper torso while the user is seated upon said bowl. The over all shape of the upper-body support (2) is smoothly rounded. When a user sits on the commode (1), the seat lid (8) is fully opened and leaned towards the upper-body support (2). The lower surface of the seat lid (8) is rounded to meet the user's stomach when it is fully opened and leaned on the upper-body support (2). The surface of the upper body support (2) is coated with one of a soft material such as artificial fur made of polyester, natural animal fur, artificial leather made of polyurethane, animal leather, silicon rubber or cotton. Surface of the upper-body support is coated with one material mentioned above or a combination of the above mentioned materials. The thickness of the surface coated material is at least 1 centimeter to 10 centimeter to make the upper-body support (2) feel like a human body. The upper body-support (2) is coated with one of the soft materials with 10 centimeters designated for a ladies commode for the softness of the upper-body support (2). The top of the upper-body support has a cover (9) that has a rounded upper surface. The upper-body support (2) may contains a water tank (2-1) inside. In that case, a flushing lever (10) is found at the side of the upper-body support (2).

Figure 2:
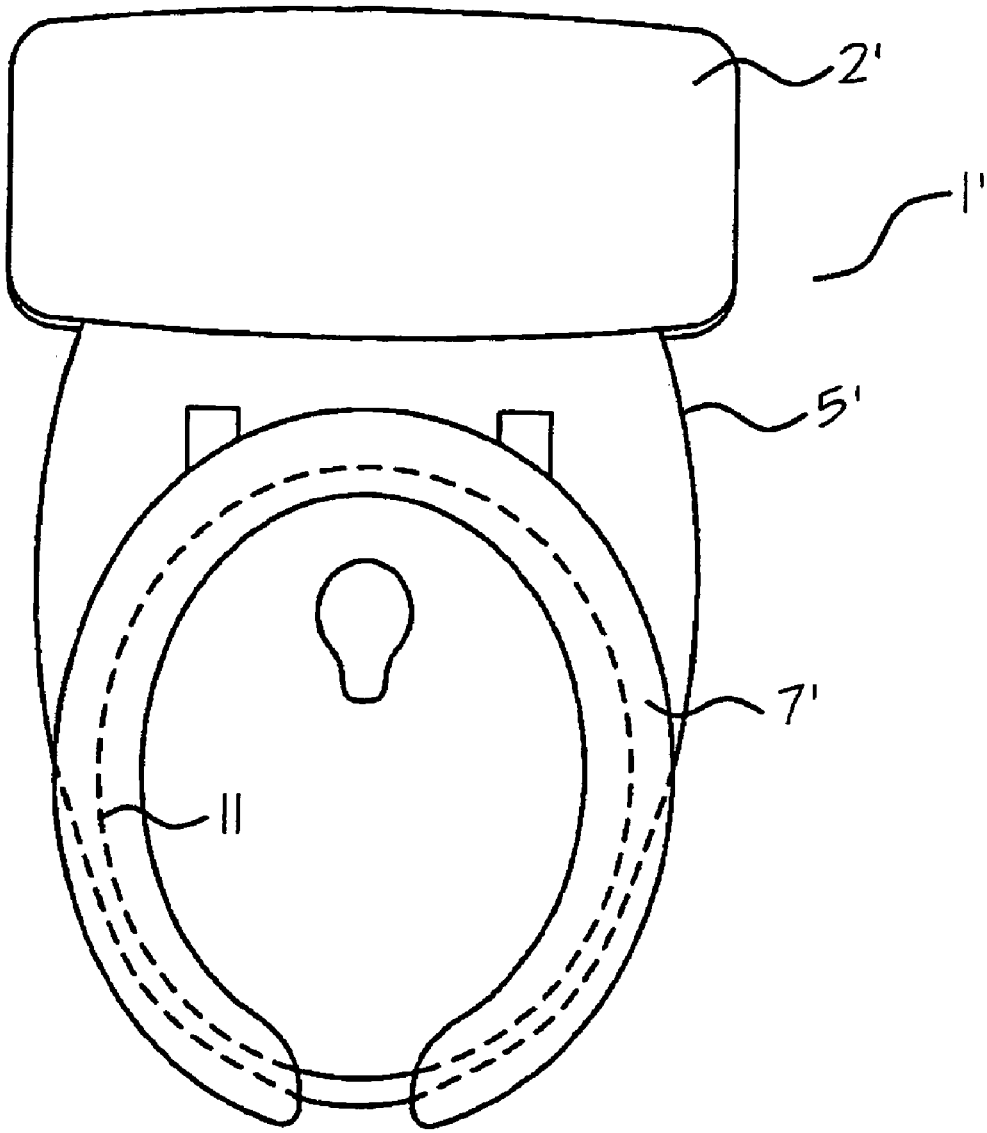
FIG.2 Prior Art
FIG. 2 is an over view of a conventional commode of the prior arts.

FIG. 2 is an over view of conventional commode of the prior art. The shape of the upper part of the bowl (5') itself is an oval whose narrow end is flat and connected to the water tank (2'). However, the bowl's opening (11) and the seat (7') are developed reversely, in other words, the side that is closest to the water tank (2') is wider and the other side is narrower. This shape is created to match the shape of a human body's lower bottom when sitting on a commode.

Figure 3:
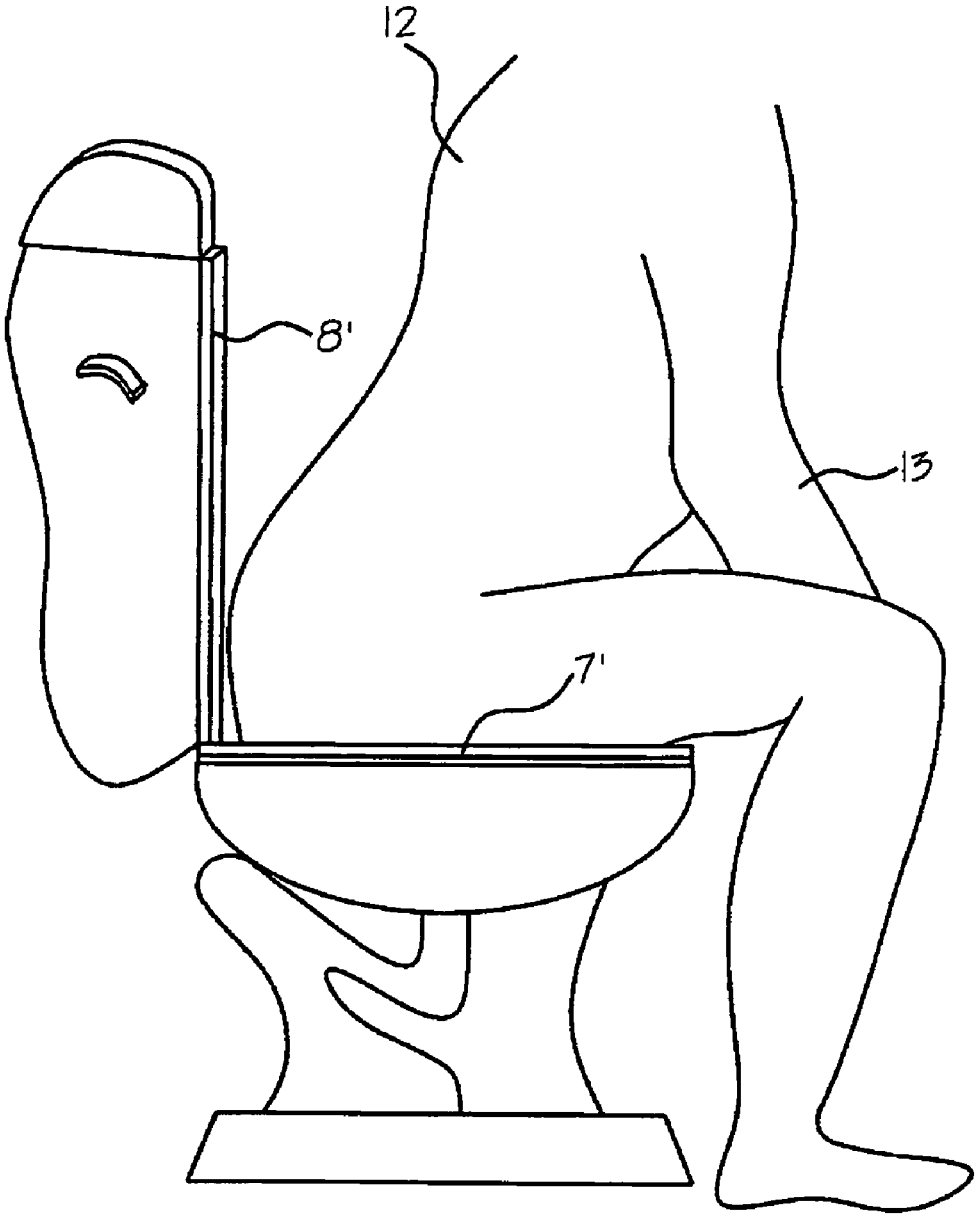
FIG.3 Prior Art
FIG. 3 is a schematic drawing of a user sitting on the conventional commode of the prior art.

FIG. 3 is a schematic drawing of a user (12) sitting on the conventional commode (1') of the prior art. When a user (12) sits on this commode (1'), all the body weight is concentrated to the contacting area with the seat (7') because a user usually leans forward and put his/her arms (13) on/between the thighs. An extended stay in this position has as variety of negative effects, including making the legs numb.

Figure 4:
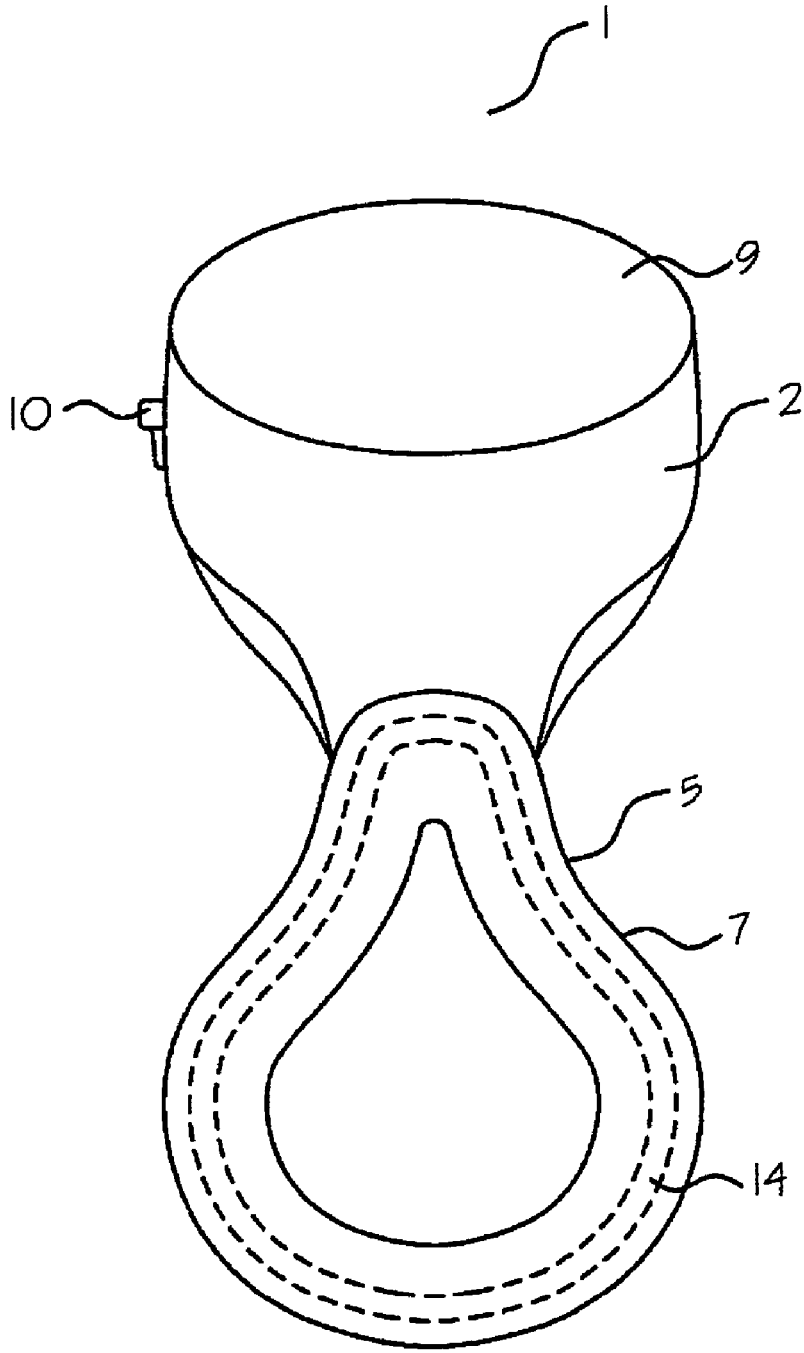
FIG. 4 is an over view of a commode with an upper-body support of the current application without sit lid.

FIG. 4 is an over view of the commode with an upper-body support (1) of the current application without a seat lid. The seat lid is not shown to make it simple. The shape of the upper part of the bowl (5) itself is a saddle of a bicycle whose narrow end is flat and connected to the upper-body support (2). The seat (7) and the mouth (14) of the bowl (5) are developed match to the bowl (5) shape, in other words, the side closest to the upper-body support (2) is narrower and the other side is wider. That shape is to match the shape of a human body's lower bottom when sitting on a commode facing the water tank.

Figure 5:
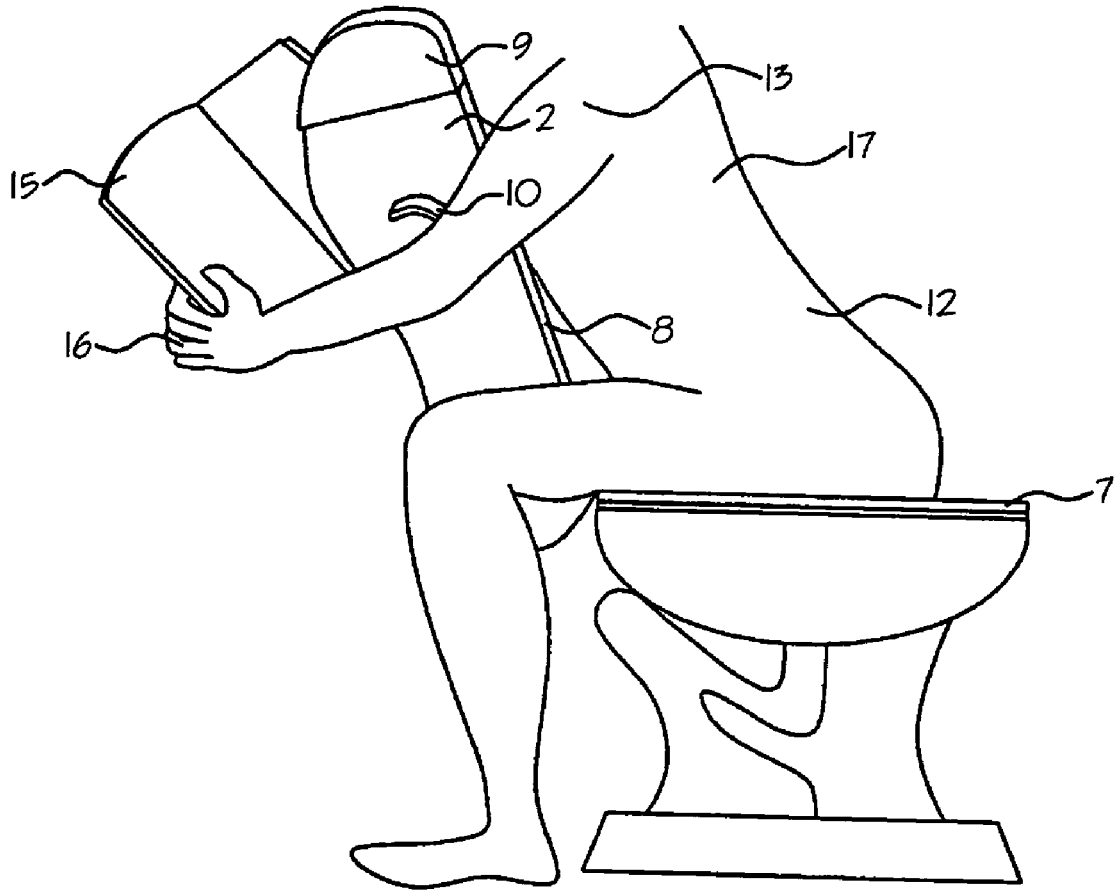
FIG. 5 is a schematic drawing of a user sitting on the commode with an upper-body support of the current application.

FIG. 5 is a schematic drawing of an user (12) sitting on the commode (1), with an upper-body support, of the current application. With this position the hands (16) and arms (13) of the user are naturally placed on the upper surface of the water tank or hug the water tank while the upper body leans on the water tank. The user can read articles (15) behind the water tank (2) while leaning his head over the water tank (2). Therefore, the commode (1) of the current application is located at least 50 centimeter from the wall. With this position, the weight of the upper body (17) of the user (12) of the current application is rested on the water tank (2) and as a result the pressure built up to the lower part of the user (12) along the seat (7) of the commode (1) of the current application is drastically reduced. If the user totally leans on the water tank (2), he/she can sit on the commode of the current application much longer than the commodes of the prior art. The commode (1) of the current application will reduce the pains from an overweight user and a user who suffers from constipation and hemorrhoids.

Even after using the commode (1), the user need not to turn around to operate the flushing lever (10).

Figure 6:
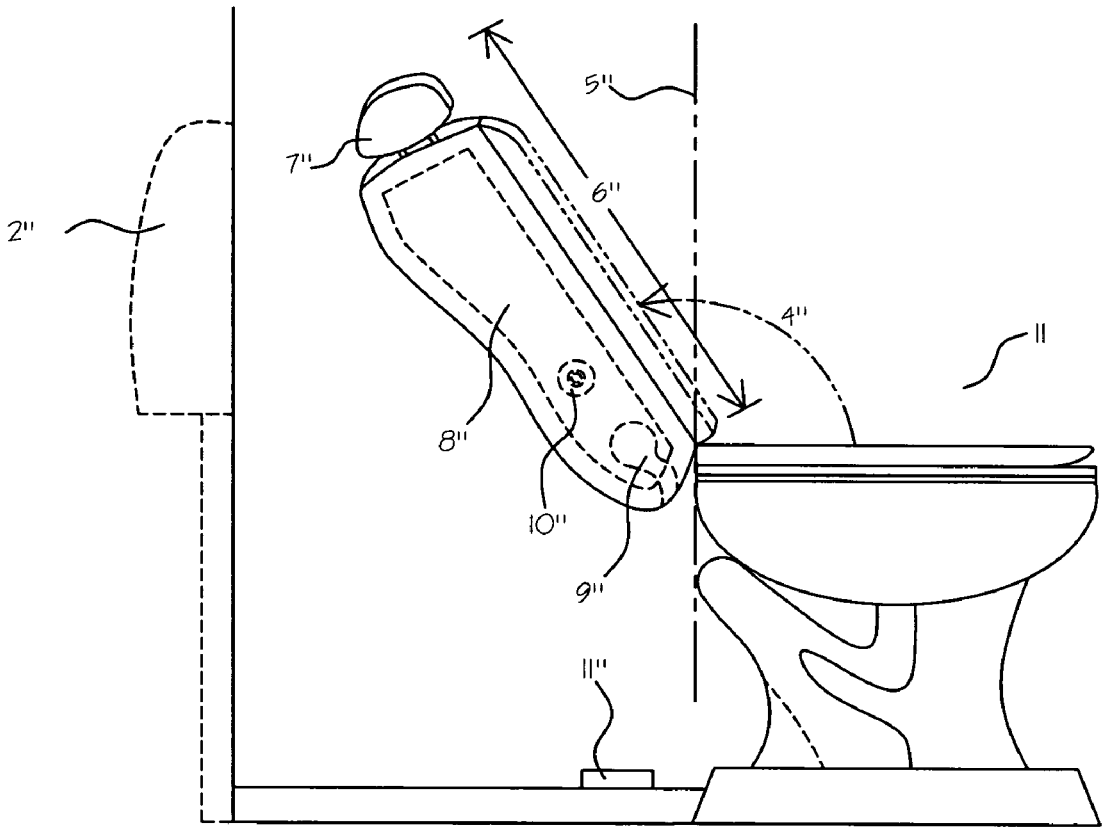
FIG. 6 is a side view of the second embodiment of a commode with an upper-body support of the current application.

FIG. 6 is a side view of second embodiment of the commode (11") with an upper-body support of the current application. The second embodiment of the commode (11") has a water tank (2") inside of the wall but has an upper-body support (3") at the position where a water tank used be placed. The upper body support (3") may be a structure that is made of ceramics, rubber, plastic, or metal. Whatever the base material is the outer surface is coated with a rubbery polymer such as silicon or polyurethane. The upper-body support (3") may be in a shape of geometrical forms, animal shape or upper-body statue of a human. The user may select his/her favorite celebrates. The upper-body support is sloped with an angle (4") of 5 degree to 90 degrees from the vertical line (5"). The angle may be adjustable. The length (6") of the upper body support is 30 centimeter to 90 centimeter. The length (6") may be adjustable by attaching a chin support (7"). It will be very helpful for a patient who heart his/her neck, chin or head. The upper-body support may contain a container (8") for vagina cleaning solution or fragrant. The upper-body support is equipped with an electric heater (9") to warm the upper-body support and the solution therein. The solution in the upper-body support (3") is ejected by a button (10") placed thereon to the bottom of a user from front direction, for ladies.

Figure 7:
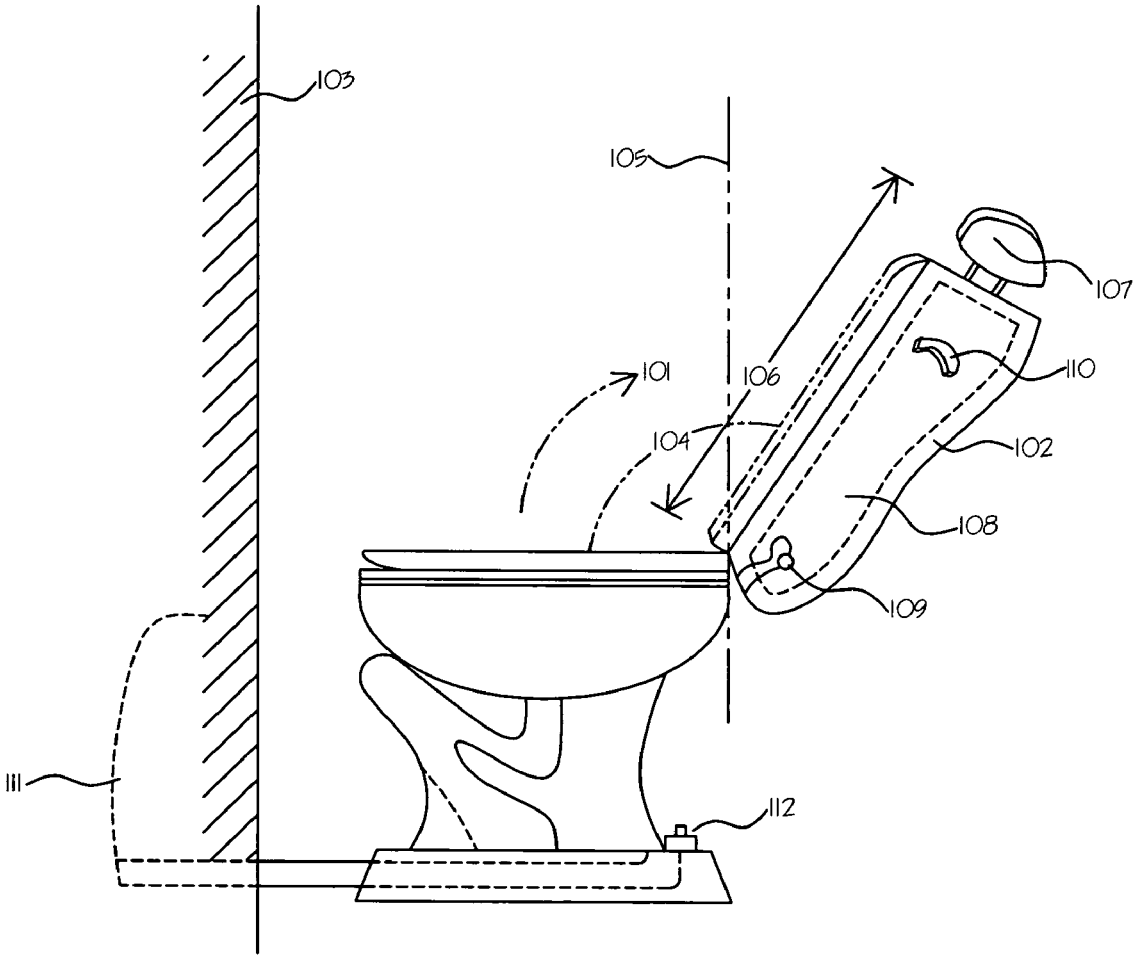
FIG. 7 is a side view of third embodiment of a commode with an upper-body support of the current application.

FIG. 7 is a side view of third embodiment of the commode (101) with an upper-body support of the current application. The upper-body support (102) of the third embodiment may be located on the opposite side of a wall (103), where a water tank usually places. The upper-body support (102) helps to reduce the weight pressure to the bottom area of a user. The upper body support places on front side of conventional commodes, which has an over view as shown in the FIG. 2. The upper-body support (102) is comprised of a solid column made of, including but not limited to, stainless steel, ceramics or solid plastic and covered with a soft rubbery polymer. The upper-body support (102) may be in a shape of geometrical forms, animal shape or upper body statue of a human. The user may select his/her favorite celebrates. The upper body support is sloped with an angle (104) of 5 degree to 90 degrees from the vertical line (105). The angle is adjustable. Length (106) of the upper body support is 30 centimeter to 90 centimeter. The length may be adjustable by attaching a chin support (107). It will be very helpful for a patent who heart his/her neck, chin or head. The upper body support may have a container (108) for vagina cleaning solution or fragrant. The upper body support is equipped with an electric (109) heater to warm the upper body support and the solution therein. The solution in the upper body support is ejected by a button (110) placed thereon to the bottom of a user from front direction, for ladies. Flushing water comes from a water tank (111) hidden in the wall (103) and activated by pushing a button (112).

Figure 8:
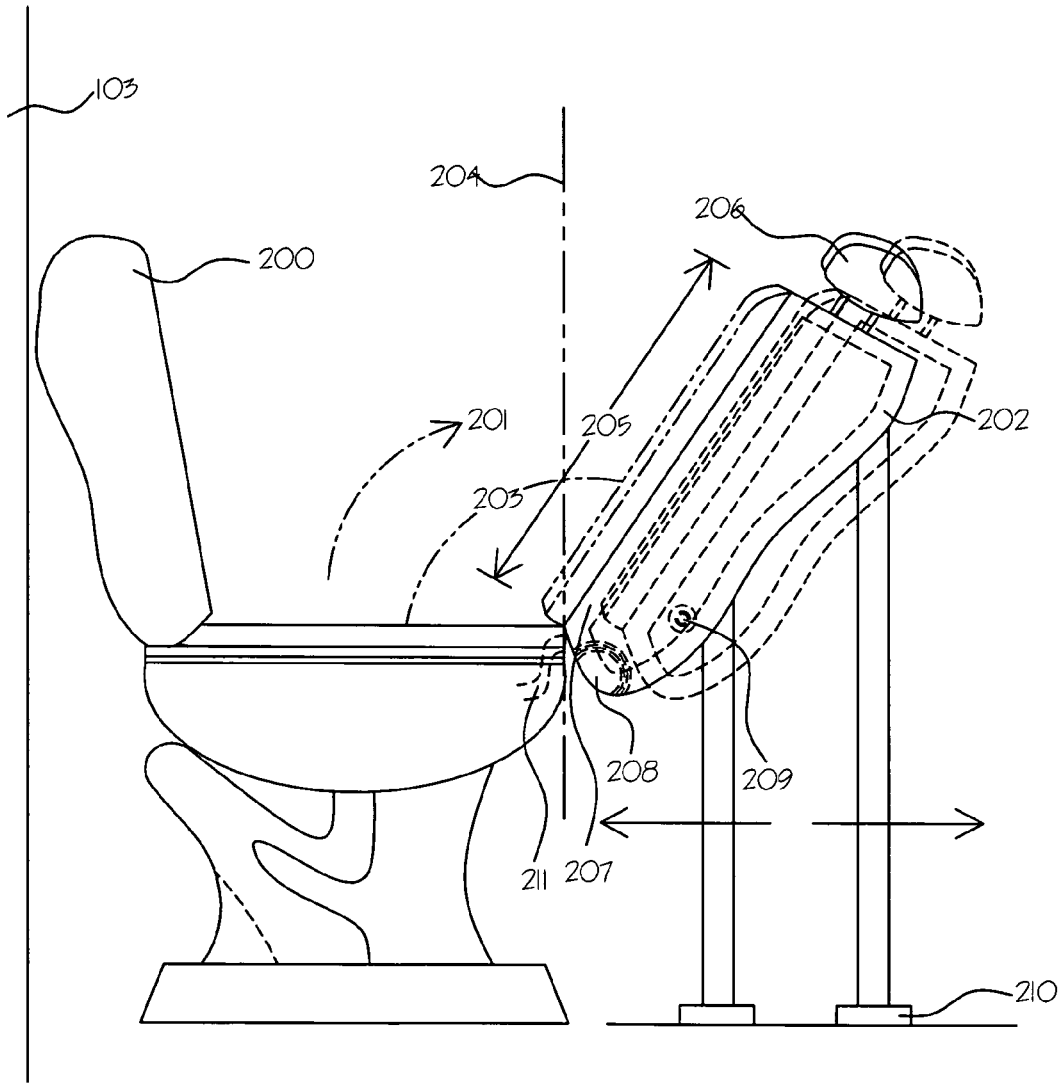
FIG. 8 is a side view of the fourth embodiment of a commode with an upper-body support of the current application.

FIG. 8 is a side view of fourth embodiment of a commode (201) with an upper-body support (202) of the current application. The upper-body support (202) may be detach-ably attached to a conventional commode without changing the commode. Therefore, the upper-body support (202) places on front side of conventional commodes. The conventional commode may have a water tank (200) at the side of wall (199). The upper body support (202) is comprised of a solid column made of, including but not limited to, stainless steel, ceramics or solid plastic and covered with a soft rubbery polymer. The upper body support may be in a shape of geometrical forms, animal shape or upper body statue of a human. The user may select his/her favorite celebrates. The upper body support is sloped with an angle (203) of 5 degree to 90 degrees from the vertical line (204). The angle may be adjustable. Length (205) of the upper body support is 30 centimeter to 90 centimeter. The length may be adjustable by attaching a chin support (206). It will be very helpful for a patent who heart his/her neck, chin or head. The upper-body support (202) may have a container (207) for vagina cleaning solution or fragrant. The upper body support is equipped with an electric heater (208) to warm the upper body support and the solution therein. The solution in the upper body support is ejected by a button (209) placed thereon to the bottom of a user from front direction, for ladies, and ejected to the vagina of the user through a nozzle (211). The detachably-attached upper-body support is reinforced by a support (210) that reaches to the ground.

Figure 9:
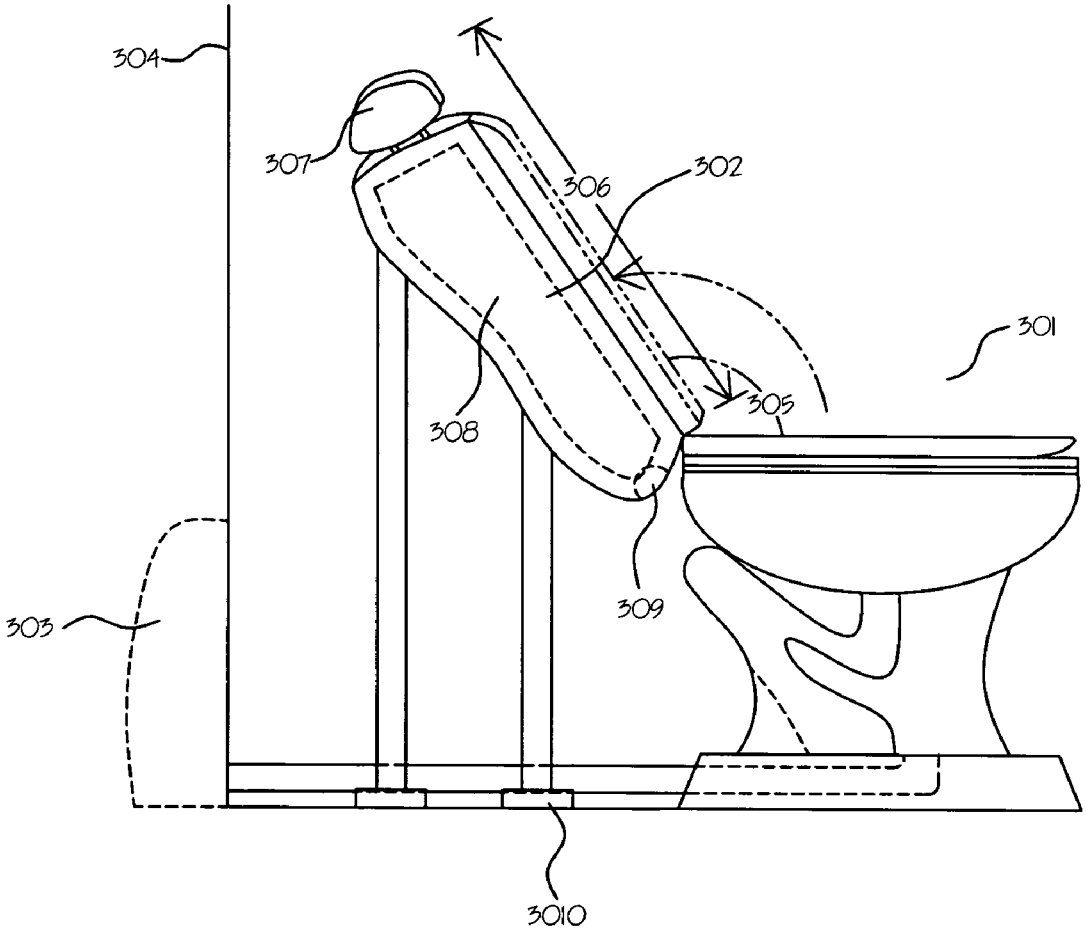
FIG. 9 is a side view of the fifth embodiment of a commode with an upper-body support of the current application.

FIG. 9 is a side view of the fifth embodiment of a commode (301) with an upper-body support of the current application. An upper-body support (302) may be detach-ably attached to a conventional commode without changing the commode. The upper-body support (302) places on rear side of conventional commodes, which does not have water tank thereon. In that case, water tank (303) usually installed inside of the wall (304) behind the commode (301). The upper-body support (302) is comprised of a solid column made of, including but not limited to, stainless steel, ceramics or solid plastic and covered with a soft rubbery polymer. The upper-body support (302) may be in a shape of geometrical forms, animal shape or upper body statue of a human. The user may select his/her favorite celebrates. The upper body support is sloped with an angle (305) of 5 degree to 90 degrees from the vertical line. The angle may be adjustable. Length (306) of the upper body support is 30 centimeter to 90 centimeter. The length may be adjustable by attaching a chin support (307). It will be very helpful for a patent who heart his/her neck, chin or head. The upper body support may have a container (308) for vagina cleaning solution or fragrant. The upper body support is equipped with an electric heater (309) to warm the upper body support and the solution therein. The solution in the upper body support is ejected by a button (310) placed thereon to the bottom of a user from rear direction, for ladies.

Here, I declare that my invention is the original and successive improvement of my previous inventions.

What is claimed is:

1. A commode comprising a toilet bowl; a water tank for flushing water; an upper-body support with an over all shape that is smoothly rounded and that is tilted in an orientation away from vertical such that an axis thereof will meet a longitudinal axis of the bowl in an obtuse angle in order for the upper body-support to lend support to a user's upper torso while the user is seated upon the bowl, the upper-body support is made of ceramics and is coated with silicone rubber with 10 centimeter thickness and has a cover that has a rounded upper surface and has a container for vagina cleaning solution for ladies, wherein the container has a button placed thereon to eject the solution so as to clean the bottom of a user from frontal direction of the user; the upper-body support is equipped with an electric heater to warm the upper body support and the solution in the container; the upper-body support further has a chin support to extend the length of the upper body support 90 centimeter; the commode further has a base and a base plate, a bowl lip, a seat, and a seat lid that is fully opened and leaned towards the upper-body support when a user sit thereon and the lower surface of the seat lid is rounded to meet the user's stomach when it is fully opened and leaned on the upper-body support.

2. A commode comprising a toilet bowl; a water tank for flushing water; an upper-body support with an over all shape that is smoothly rounded and that is tilted in an orientation away from vertical such that an axis thereof will meet a longitudinal axis of the bowl in an obtuse angle in order for the upper body-support to lend support to a user's upper torso while the user is seated upon a bowl, and is located on the opposite side of a wall and is made of stainless steel in a shape of geometrical forms and is coated with silicone rubber with 10 centimeter thickness and has a cover that has a rounded upper surface and has a container for vagina cleaning solution for ladies, wherein the container has a button placed thereon to eject the solution so as to clean the bottom of a user from frontal direction of the user; the upper-body support is equipped with an electric heater to warm the upper body support and the solution in the container; the upper-body support further has a chin support to extend the length of the upper body support 90 centimeter; the commode further has a base and a base plate, a bowl lip, a seat, and a seat lid that is fully opened and leaned towards the upper-body support when a user sit thereon and the lower surface of the seat lid is rounded to meet the user's stomach when it is fully opened and leaned on the upper-body support.

3. A commode comprising a toilet bowl; a water tank for flushing water; an upper-body support with an over all shape that is smoothly rounded and detachably attached to front side of the commode opposite the water tank, the upper-body support is tilted in an orientation away from vertical such that an axis thereof will meet a longitudinal axis of the bowl in an obtuse angle in order for the upper body-support to lend support to a user's upper torso while the user is seated upon a bowl, and is located on the opposite side of a wall of a bathroom; the upper body-support is made of plastic in a shape of geometrical forms and is coated with polyurethane rubber with 10 centimeter thickness and has a cover that has a rounded upper surface and has a container for vagina cleaning solution for ladies, wherein the container has a button placed thereon to eject the solution so as to clean the bottom of a user from frontal direction of the user; the upper-body support is equipped with an electric heater to warm the upper body support and the solution in the container; the upper-body support further has a chin support to extend the length of the upper body support 90 centimeter; the commode further has a base and a base plate, a bowl lip, a seat, and a seat lid that is fully opened and leaned towards the upper-body support when a user sit thereon and the lower surface of the seat lid is rounded to meet the user's stomach when it is fully opened and leaned on the upper-body support.

* * * * *